US007469114B2

(12) United States Patent
Koido et al.

(10) Patent No.: US 7,469,114 B2
(45) Date of Patent: Dec. 23, 2008

(54) IMAGE FORMING APPARATUS AND SHEET FEEDING DEVICE IN WHICH WEIGHT EXERTED ON LIFTING HANDLES IS EQUALIZED

(75) Inventors: Kazunori Koido, Nagano (JP); Toru Tanjo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 341 days.

(21) Appl. No.: 11/333,097

(22) Filed: Jan. 17, 2006

(65) Prior Publication Data

US 2006/0182464 A1 Aug. 17, 2006

(30) Foreign Application Priority Data

Jan. 18, 2005 (JP) ..... 2005-009935
Jan. 18, 2005 (JP) ..... 2005-009936

(51) Int. Cl.
*G03G 15/00* (2006.01)

(52) U.S. Cl. ..... 399/107; 399/108

(58) Field of Classification Search ..... 399/107, 399/108, 381, 393
See application file for complete search history.

(56) References Cited

U.S. PATENT DOCUMENTS 4,635,010 A * 1/1987 Miyai et al. ..... 399/108
4,789,876 A * 12/1988 Miyai et al. ..... 399/108
5,270,772 A 12/1993 Akiyama et al.
6,834,172 B2 * 12/2004 Tomita ..... 399/108

FOREIGN PATENT DOCUMENTS

JP 57-006858 1/1982
JP 60-188963 9/1985
JP 06-329270 11/1994
JP 1183592 9/2003

OTHER PUBLICATIONS

European Search Report (Mar. 21, 2006).

* cited by examiner

*Primary Examiner*—William J Royer
(74) *Attorney, Agent, or Firm*—Hogan & Hartson LLP

(57) ABSTRACT

A second side face opposes to a first side face. A first handle is provided on the first side face at a first position and adapted to be used to lift an image forming apparatus. A second handle is provided on the second side face at a second position which is higher than the first position, and adapted to be used to lift the image forming apparatus together with the first handle. A center of gravity for the image forming apparatus is located closer to the first side face than the second side face.

6 Claims, 3 Drawing Sheets

IMAGE FORMING APPARATUS AND SHEET FEEDING DEVICE IN WHICH WEIGHT EXERTED ON LIFTING HANDLES IS EQUALIZED

BACKGROUND OF THE INVENTION

The present invention relates to an image forming apparatus such as a printer, a facsimile, a copying machine, and a sheet feeding device which is selectively installed in the image forming apparatus as required.

Generally, the image forming apparatus is provided with handles for lifting it, at right and left sides (or in front and back, the case is the same in the following description) of the apparatus.

Japanese Design Registration No. 1183592, for example, discloses an image forming apparatus in which such handles are provided at the same level.

Generally, a center of gravity for the image forming apparatus is rarely positioned at the center in a horizontal direction, but usually biased to the left or to the right.

In the image forming apparatus, in which the handles for lifting the apparatus are provided at the same level, there is such a problem that in a case where two persons, for example, lift and carry the apparatus, a larger weight is exerted on the person who handles the handle at the side where the center of gravity is biased.

There is also the same problem described above in the sheet feeding device which is adapted to be attached to the image forming apparatus to feed a recording medium thereto, and to store recording media.

Japanese Patent Publication No. 6-329270A discloses an image forming apparatus or a sheet feeding device, which is provided with a separating hook for feeding an uppermost one of recording media stack in a main body of the image forming apparatus.

In such an image forming apparatus 1 or sheet feeding device OP, as shown in FIGS. 2A and 2B, a handle 2R' at a side where a separating hook 3 is provided and a handle 2L' at an opposite side thereto is provided at the same level. Therefore, in a case where a center of gravity G is biased toward the side where the separating hook 3 is provided, there is such probability that a bottom 1*a* of the apparatus 1 at the side where the separating hook 3 is provided may first strike an installation face FL, when the apparatus 1 is placed on the installation face FL.

When the bottom 1*a* of the apparatus 1 at the side where the separating hook 3 is provided is first struck the installation face FL as shown in FIG. 2B, this will enhance such probability that recording media S stacked inside the apparatus 1 may rapidly move toward the separating hook 3 due to a shock at the time of placing the apparatus 1 on the installation face FL, thereby colliding with the separating hook 3, and the separating hook 3 may be damaged by the collision.

The separating hook 3 is provided for the purpose of applying flexure to both corner parts of the uppermost sheet of the recording media S thereby to separate the uppermost sheet from lower sheets of the recording media S, and so, accuracies of the separating hook 3 in shape and in position are important. Therefore, in a case where the accuracies in its shape and position become out of order, receiving the impact of the recording media S, recording media S may not be properly separated, and that the recording media S may not be fed to a proper position of a main body 1*c* of the image forming apparatus 1.

SUMMARY OF THE INVENTION

It is therefore an object of the invention to provide an image forming apparatus and an optional sheet feeding device in which weights to be exerted on the two handles can be equalized.

It is also an object of the invention to provide an image forming apparatus and an optional sheet feeding device in which the separating hook is unlikely to be damaged.

In order to attain the above described objects, according to the invention, there is provided an image forming apparatus comprising:

a first side face;

a second side face, opposing the first side face;

a first handle, provided on the first side face at a first position and adapted to be used to lift the image forming apparatus; and a second handle, provided on the second side face at a second position which is higher than the first position, and adapted to be used to lift the image forming apparatus together with the first handle, wherein a center of gravity for the image forming apparatus is located closer to the first side face than the second side face.

According to the invention, there is also provided a sheet feeding device adapted to be attached to an image forming apparatus to feed recording media thereto, the sheet feeding device comprising:

a first side face;

a second side face, opposing the first side face;

a first handle, provided on the first side face at a first position and adapted to be used to lift the sheet feeding device; and a second handle, provided on the second side face at a second position which is higher than the first position, and adapted to be used to lift the sheet feeding device together with the first handle;

wherein a center of gravity for the sheet feeding device is located closer to the first side face than the second side face.

With the above configurations, when the apparatus is lifted by handling the two handles, heights of the two handles will be substantially the same, and the center of gravity will move relatively toward the handle which is provided at the higher position.

As a result, the weights to be exerted on the two handles can be equalized.

The image forming apparatus may further comprise:

a sheet feeding device, adapted to store recording media which are to be fed to a main body of the image forming apparatus;

a separating hook, provided in the sheet feeding device at a position closer to a first side face than a second side face, and operable to separate one of the recording media which is to be fed to the main body.

The sheet feeding device may further comprise:

a separating hook, provided in the sheet feeding device at a position closer to a first side face than second side face, and operable to separate recording media which is to be fed to a main body of an image forming apparatus.

With the above configurations, when the apparatus is placed on an installation face, the apparatus is highly liable to strike the installation face from a bottom thereof at the side of the handle which is provided at the higher position, that is, at the opposite side to the side where the separating hook is provided.

Therefore, such phenomenon that the sheets of the recording media which are contained inside the apparatus may rapidly move toward the separating hook due to a shock at the time of placing the apparatus on the installation face, thereby colliding with the separating hook will be unlikely to happen. As a result, probability that the separating hook may be damaged with the collision will be advantageously decreased.

According to the invention, there is also provided an image forming apparatus comprising:

a first side face;

a second side face, opposing the first side face;

a first handle, provided on the first side face at a first position and adapted to be used to lift the image forming apparatus;

a second handle, provided on the second side face at a second position which is higher than the first position, and adapted to be used to lift the image forming apparatus together with the first handle; and a separating hook provided at a position closer to the first side face than the second side face, and operable to separate recording media which is to be fed to a main body of the image forming apparatus.

According to the invention, there is also provided a sheet feeding device adapted to be attached to an image forming apparatus to feed recording media thereto, the sheet feeding device comprising:

a first side face;

a second side face, opposing the first side face;

a first handle, provided on the first side face at a first position and adapted to be used to lift the sheet feeding device;

a second handle, provided on the second side face at a second position which is higher than the first position, and adapted to be used to lift the sheet feeding device together with the first handle; and a separating hook provided at a position provided at a position closer to the first side face than the second side face, and operable to separate one of the recording media which is to be fed to a main body of the image forming apparatus.

With the above configurations, when the apparatus is placed on an installation face, the apparatus is highly liable to strike the installation face from the bottom thereof at the side of the handle which is provided at the higher position, that is, at the opposite side to the side where the separating hook is provided regardless of the position where the center of gravity for the apparatus is.

Therefore, such phenomenon that the sheets of the recording media which are contained inside the apparatus may rapidly move toward the separating hook due to a shock at the time of placing the apparatus on the installation face, thereby colliding with the separating hook will be unlikely to happen regardless of the position where the center of gravity for the apparatus is. As a result, the probability that the separating hook may be damaged with the collision will be advantageously decreased.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

First Embodiment

Embodiments of the invention will be described below in detail with reference to the accompanying drawings.

Figure 1A:
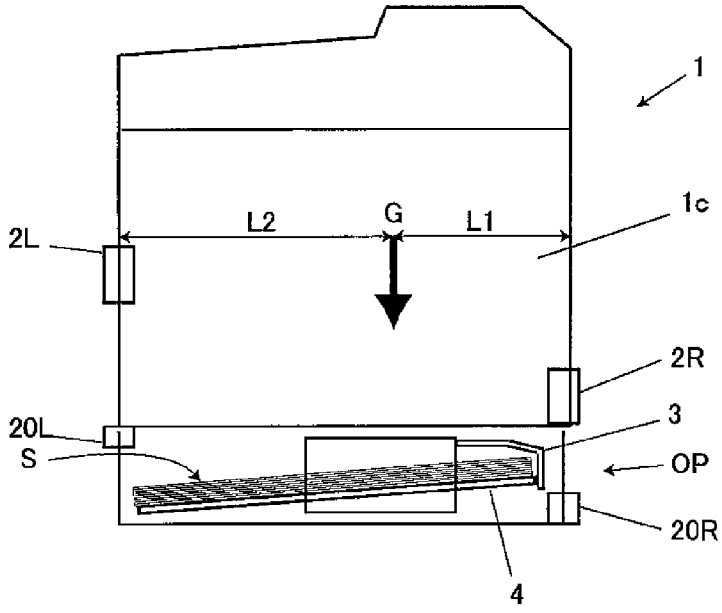
FIG. 1A is a schematic front view of an image forming apparatus according to a first embodiment of the invention.

As shown in FIG. 1A, an image forming apparatus 1 according to a first embodiment of the invention has a center of gravity G which is biased to the right in a horizontal direction. Handles 2R and 2L for lifting the apparatus 1 are respectively provided at the right and left side of the apparatus 1.

Figure 2A:
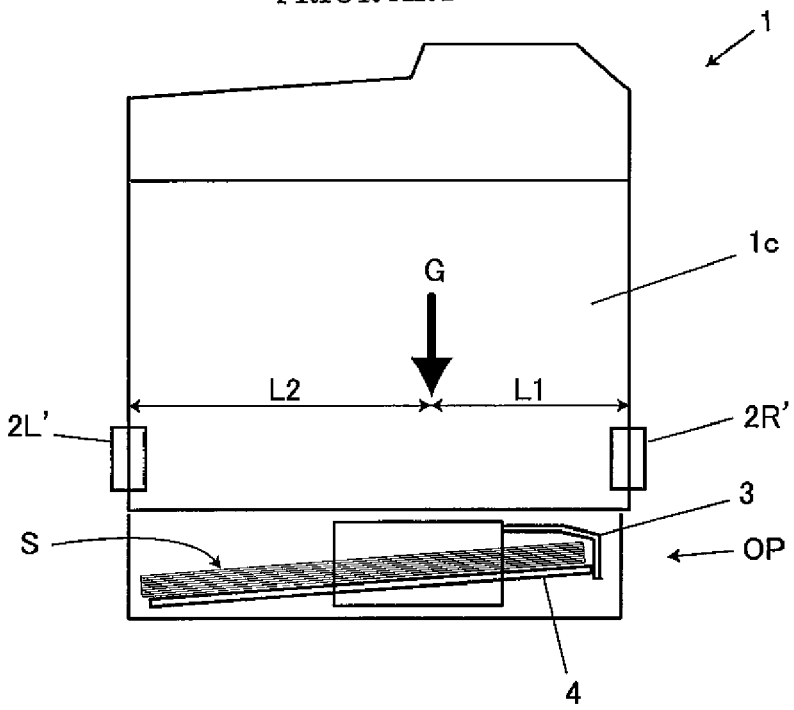
FIG. 2A PRIOR ART
FIG. 2A is a schematic front view of an image forming apparatus according to a related art.
Figure 2B:
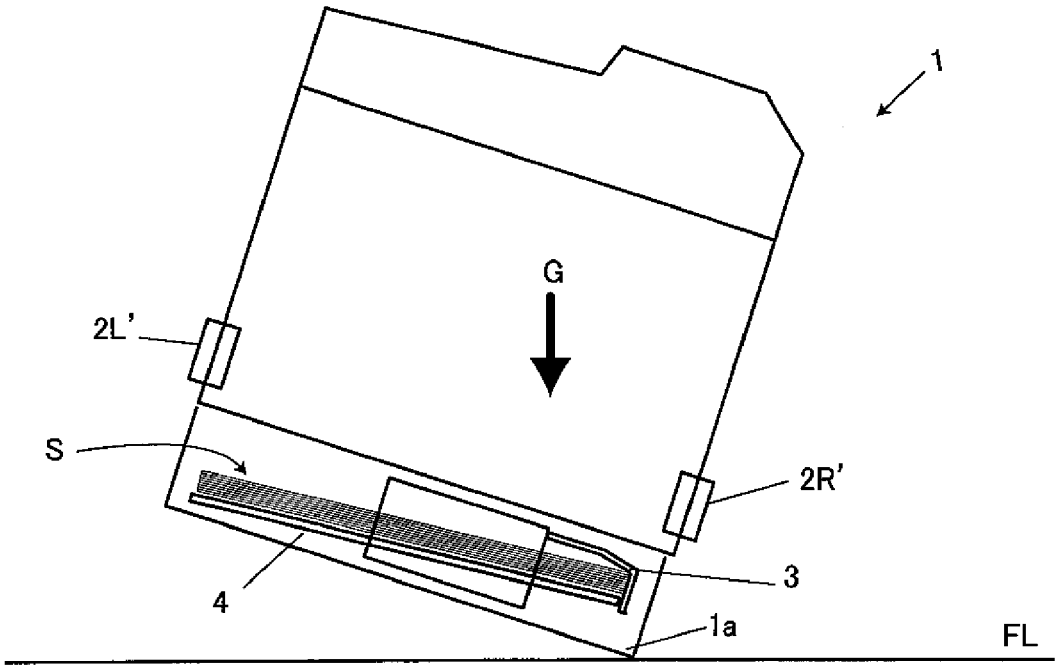
FIG. 2B PRIOR ART
FIG. 2B is a schematic front view of the image forming apparatus of FIG. 2A, showing a state that the apparatus is inclined.

In the apparatus 1 of this type, provided that the handles 2L', 2R' are provided at the same level as shown in FIG. 2A, in a case where two persons lift and carry the apparatus 1 with these handles 2L', 2R', a larger weight will be exerted on the person at the side where the center of gravity G is biased, that is, the person who handles the right handle 2R', in this case.

There is also the same problem described above in the sheet feeding device OP which is adapted to be attached to the image forming apparatus 1 to feed recording media S thereto, and to store recording media S.

Under the circumstances, in this embodiment, the handle at the side where the center of gravity G is biased, that is, the right handle 2R, in this case, is provided at a lower position than the other handle 2L, as shown in FIG. 1A. In a case where the apparatus is the sheet feeding device (for example, in a case where the sheet feeding device denoted by a sign OP in FIG. 1A is the sheet feeding device), the structure will be also the same. In this case, the right and left handles are denoted by 20R and 20L.

Figure 1B:
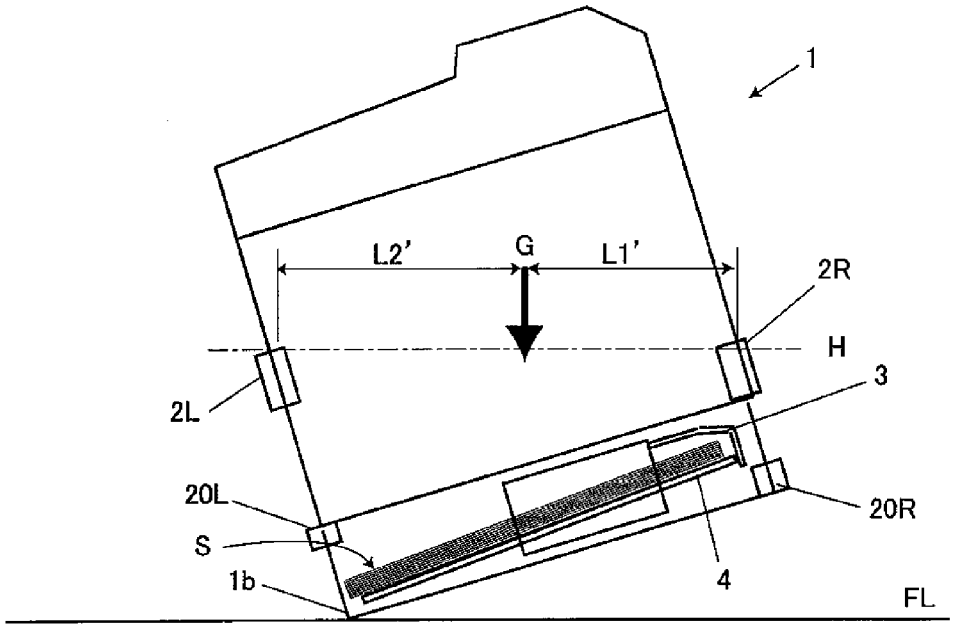
FIG. 1B is a schematic front view of the image forming apparatus of FIG. 1A, showing a state that the apparatus is inclined.

According to this structure, when the apparatus 1 is lifted by handling the two handles 2L, 2R, heights H of the two handles 2R, 2L will be substantially the same, as shown in FIG. 1B, and the center of gravity G will move relatively toward the handle 2L which is provided at the higher position.

As shown in FIG. 1A, provided that a distance between the center of gravity G and the handle 2R in the horizontal direction is L1, and a distance between the center of gravity G and the handle 2L in the horizontal direction is L2, the distance L2 has been apparently larger than the distance L1 (L2>L1) in a state before the apparatus is lifted. However, when the two handles 2L, 2R are positioned at substantially the same height H, as shown in FIG. 1B, the position of the center of gravity G will move relatively toward the higher handle 2L in the horizontal direction, whereby the distance between the center of gravity G and the handle 2R in the horizontal direction becomes L1' (>L1), and the distance between the center of gravity G and the handle 2L becomes L2' (<L2), so that the distance L1' may become equal to the distance L2' (L1'=L2').

As a result, the weights to be exerted on the two handles 2L, 2R will be equalized.

Specifically, as compared with the handle 2R at the side where a separating hook 3 is provided, the handle 2L at the opposite side is provided at the higher position, as shown in FIG. 1A. Accordingly, when the apparatus 1 is placed on an installation face FL, the apparatus 1 will be highly liable to strike the installation face FL from a bottom 1*b* of the apparatus 1 at the side of the handle 2L which is provided at the higher position, as shown in FIG. 1B.

Therefore, such phenomenon that the sheets of the recording media S which are contained inside the apparatus 1 may rapidly move toward the separating hook 3 due to a shock at the time of placing the apparatus 1 on the installation face FL, thereby colliding with the separating hook 3 will be unlikely to happen. As a result, the probability that the separating hook 3 may be damaged with the collision will be decreased.

In the drawings, denoted by numeral 4 is a pushup plate for pushing up the stacked sheets of the recording media S toward a sheet feeding roller which is not shown.

Second Embodiment

Next, a second embodiment of the invention will be described. Components similar to those in the first embodiment will be designated by the same reference numerals and repetitive explanations for those will be omitted.

Figure 3A:
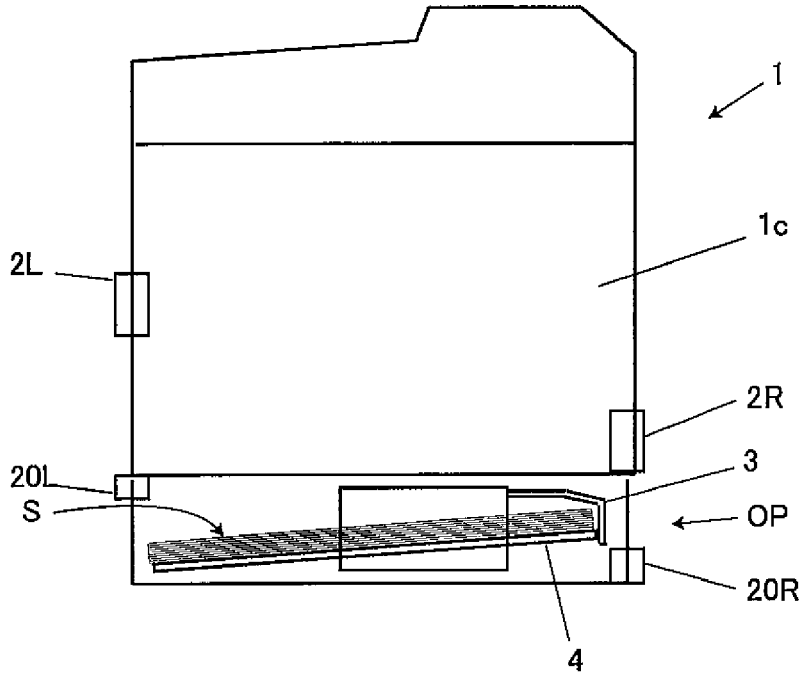
FIG. 3A is a schematic front view of an image forming apparatus according to a second embodiment of the invention.
Figure 3B:
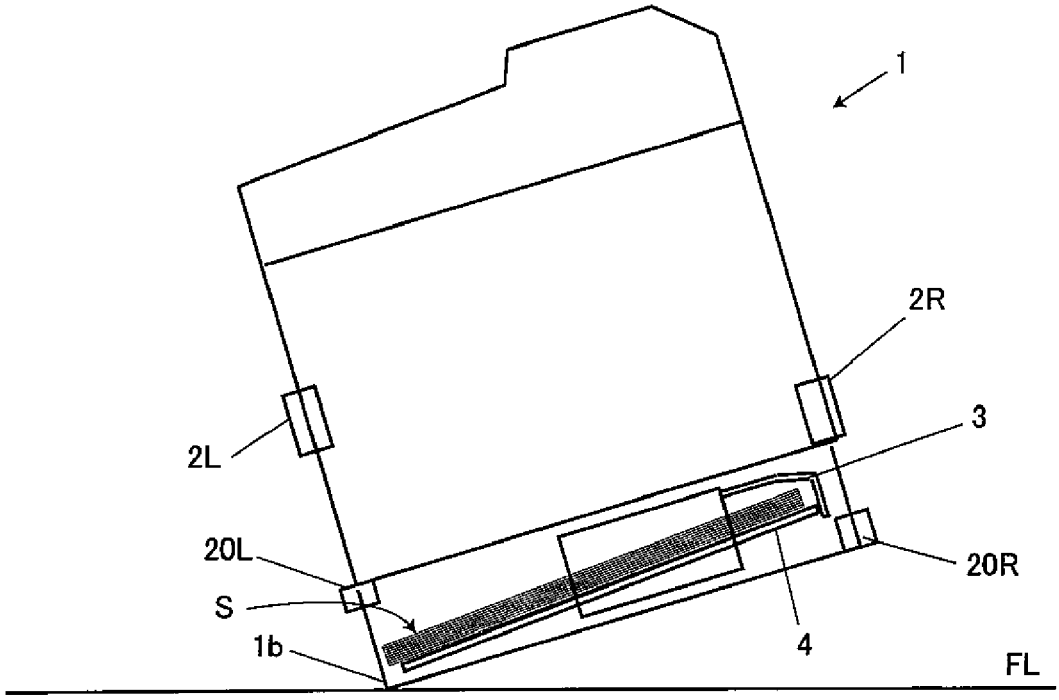
FIG. 3B is a schematic front view of the image forming apparatus of FIG. 3A, showing a state that the apparatus is inclined.

In the second embodiment, the handle 2R at the side where the separating hook 3 is provided is provided at a lower level than the handle 2L at the opposite side regardless of the center of gravity of the apparatus 1, as shown in FIG. 3A.

According to this structure, it will be highly probable that the apparatus 1 may strike the installation face FL from the bottom 1*b* of the apparatus 1 at the side of the handle 2L which is provided at the higher position, that is, the opposite side to the side where the separating hook 3 is provided regardless of the position where the center of gravity for the apparatus 1 is.

Therefore, such phenomenon that the sheets of recording media S which are contained inside the apparatus 1 may rapidly move toward the separating hook 3 due to a shock at the time of placing the apparatus 1 on the installation face FL, thereby colliding with the separating hook 3 will be unlikely to happen regardless of the position where the center of gravity for the apparatus 1 is. As a result, such probability that the separating hook 3 may be damaged with the collision will be decreased.

Although the invention has been heretofore described referring to the embodiments, the invention is not limited to the above described embodiments, but various modifications can be appropriately made within a scope of the gist of the invention.

What is claimed is:

1. An image forming apparatus comprising:

a first side face;

a second side face, opposing the first side face;

a first handle, provided on the first side face at a first position and adapted to be used to lift the image forming apparatus; and a second handle, provided on the second side face at a second position which is higher than the first position, and adapted to be used to lift the image forming apparatus together with the first handle, wherein a center of gravity for the image forming apparatus is located closer to the first side face than the second side face.

2. An image forming apparatus as set forth in claim 1 further comprising:

a sheet feeding device, adapted to store recording media which are to be fed to a main body of the image forming apparatus;

a separating hook, provided in the sheet feeding device at a position closer to the first side face than the second side face, and operable to separate one of the recording media which is to be fed to the main body.

3. A sheet feeding device adapted to be attached to an image forming apparatus to feed recording media thereto, the sheet feeding device comprising:

a first side face;

a second side face, opposing the first side face;

a first handle, provided on the first side face at a first position and adapted to be used to lift the sheet feeding device; and a second handle, provided on the second side face at a second position which is higher than the first position, and adapted to be used to lift the sheet feeding device together with the first handle;

wherein a center of gravity for the sheet feeding device is located closer to the first side face than the second side face.

4. A sheet feeding device as set forth in claim 3 further comprising:

a separating hook, provided in the sheet feeding device at a position closer to the first side face than the second side face, and operable to separate one of the recording media which is to be fed to a main body of the image forming apparatus.

5. An image forming apparatus comprising:

a first side face;

a second side face, opposing the first side face;

a first handle, provided on the first side face at a first position and adapted to be used to lift the image forming apparatus;

a second handle, provided on the second side face at a second position which is higher than the first position, and adapted to be used to lift the image forming apparatus together with the first handle; and a separating hook provided at a position closer to the first side face than the second side face, and operable to separate the recording media which is to be fed to a main body of the image forming apparatus.

6. A sheet feeding device adapted to be attached to an image forming apparatus to feed recording media thereto, the sheet feeding device comprising:

a first side face;

a second side face, opposing the first side face;

a first handle, provided on the first side face at a first position and adapted to be used to lift the sheet feeding device;

a second handle, provided on the second side face at a second position which is higher than the first position, and adapted to be used to lift the sheet feeding device together with the first handle; and a separating hook provided at a position closer to the first side face than the second side face, and operable to separate the recording media which is to be fed to a main body of the image forming apparatus.

* * * * *